United States Patent [19]

Abendroth

[11] 4,449,342

[45] May 22, 1984

[54] FLOORING SYSTEM

[76] Inventor: Carl W. Abendroth, 210 Crystal Ave., Crystal Falls, Mich. 49920

[21] Appl. No.: 387,184

[22] Filed: Jun. 10, 1982

[51] Int. Cl.[3] ..... E02D 27/00

[52] U.S. Cl. ..... 52/393; 52/480

[58] Field of Search ..... 52/480, 403, 393

[56] References Cited

U.S. PATENT DOCUMENTS

| | | | |
|---|---|---|---|
| Re. 18,573 | 8/1932 | Kocher . | |
| Re. 26,239 | 7/1967 | Rockabrand et al. | 52/403 |
| 2,554,657 | 5/1951 | Betterton et al. | 52/393 X |
| 2,862,255 | 12/1958 | Nelson . | |
| 3,045,294 | 7/1962 | Livezey, Jr. . | |
| 3,270,475 | 9/1966 | Kodaras | 52/480 |
| 3,473,281 | 10/1969 | Omholt | 52/480 |
| 3,604,173 | 9/1971 | Dahlborg | 52/508 |

*Primary Examiner*—Carl D. Friedman

*Attorney, Agent, or Firm*—James Earl Lowe, Jr.

[57] ABSTRACT

A floating system comprising a foundation, support members on the foundation, floating members on the foundation and location between and generally parallel to support members, floorboards superposed on the support members and the floating members, strips of resilient material between the floating members and the floorboards, and means for fastening the floorboards to the support members so that the strips of resilient material are in compression between the floorboards and the floating members.

11 Claims, 5 Drawing Figures

FLOORING SYSTEM

BACKGROUND OF THE INVENTION

This invention relates to flooring systems and, more particularly, to flooring systems including floating sleepers.

Various systems for applying, mounting and securing floorboards to support means have been proposed to provide a resilient sports floor surface. Examples of such flooring systems can be found in Dahlborg U.S. Pat. No. 3,604,173, Nelson U.S. Pat. No. 2,862,255, Omholt U.S. Pat. No. 3,473,281, Rockabrand et al U.S. Pat. Re. No. 26,239 and Livezey U.S. Pat. No. 3,045,294.

Kocher U.S. Pat. Re. No. 18,573 discloses a sound deadening device for use particularly in floor construction. The sound deadening device includes a felt strip both above and below a wooden sleeper used for supporting floorboards. Kodaras U.S. Pat. No. 3,270,475 discloses wooden support members with a bottom base layer of soft low density cushioning material and a top layer of soft compressible material.

SUMMARY OF THE INVENTION

This invention provides a flooring system comprising a foundation, support members on the foundation, floating members on the foundation and located between and generally parallel to the support members, floorboards superposed on the support members and the floating members, strips of resilient material between the floating members and the floorboards, and means for fastening the floorboards to the support members so that the strips of resilient material are in compression between the floorboards and the floating members.

This invention also provides a flooring system including rows of wooden support members on a foundation. Restraining strips are attached to and extend along the tops of the wooden support members to resist the upward lifting thrust of floorboards attached to the support members. The restraining strips are essentially free from dimensional changes in the presence of moisture. As a result, the strips restrain the support members against growth parallel to the longitudinal axis of the wooden support members.

Placed on the foundation and located between each row of wooden support members are rows of wooden floating members. Attached to and extending along the length of the tops of the floating members are strips of resilient material.

Superposed on the support members and restraining strips, and the floating members and strips of resilient material are floorboards. The floorboards are fastened to the support members and restraining strips. Since the combined height of an uncompressed strip of resilient material and one of the floating members is greater than the combined height of a restraining strip and one of the support members, the strips of resilient material are in compression between the floating members and the floorboards in the completed floor system.

One of the principal features of this invention is the provision of a relatively inexpensive flooring system under uniform tension which deflects as well as more costly flooring systems. A flooring system under uniform tension provides full cushioning of impacts for shock absorbing actin with an uniform response, thereby making the floor ideal as a high performance sports surface.

Figure 1:
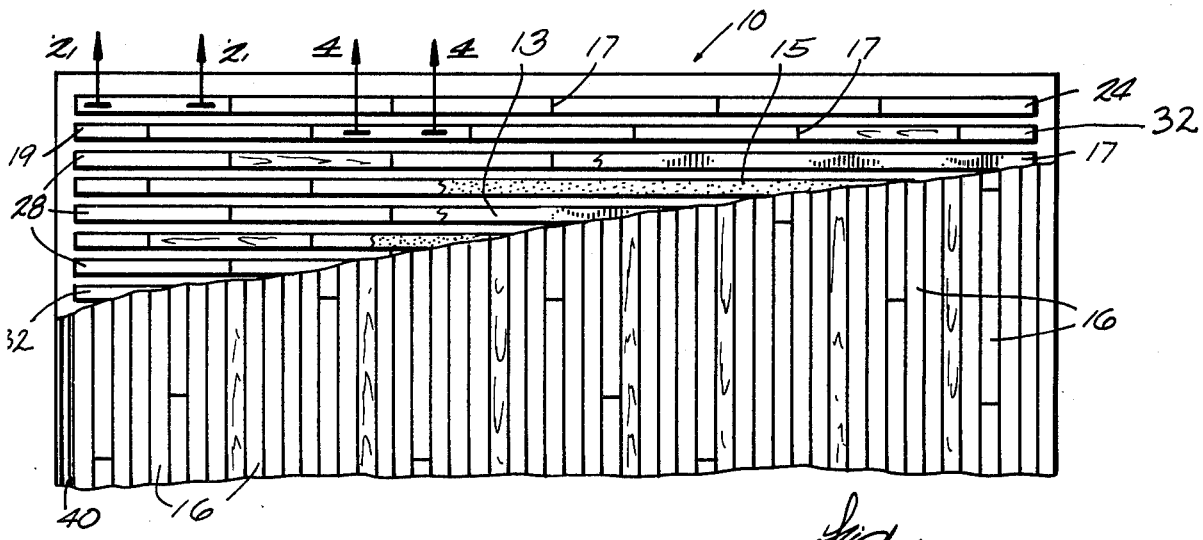
FIG. 1 is a top view of a flooring system partially in section.

Before explaining at least one embodiment of the invention in detail, it is to be understood that the invention is not limited in its application to the details of construction and the arrangements of the components set forth in the following description or illustrated in the drawings. The invention is capable of other embodiments, and of being practiced or carried out in various ways. Also, it is to be understood that the phraseology and terminology employed herein is for the purposes of description and should not be regarded as limiting.

DESCRIPTION OF THE PREFERRED EMBODIMENT

With particular reference to the drawings, a flooring system 10 is illustrated including a foundation 11, a vapor barrier 12, support assemblies 13, floating assemblies 15, and floorboards 16.

Figure 5:
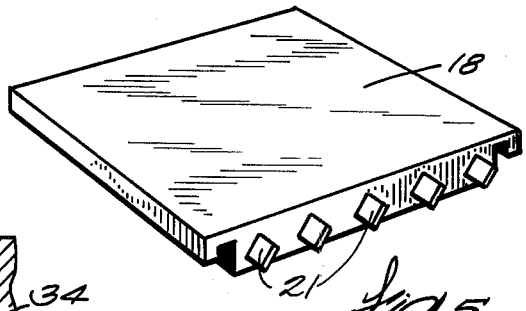
FIG. 5 is a perspective view of a pad of resilient material.

The support assemblies 13 and floating assemblies 15 both include wooden sleepers. The wooden sleeper in each support assembly 13 will be referred to as a support member 17, and the wooden sleeper in each floating assembly 15 will be referred to as a floating member 19. All of the wooden sleepers have pads 18 of resilient material, preferably made of rubber, attached to and spaced along the underneath of the sleepers. The pads 18 improve the shock absorbing ability of the flooring system 10. The pads 18 include air voids 21, as illustrated in FIG. 5, to make them more springy, and the pads 18 have uniform dimensions.

The foundation or slab 11 is a concrete subfloor which has been finished and leveled. Placed on top of the leveled slab 11 is the vapor barrier 12, preferably of 6 mil. polyethylene.

The wooden support assemblies 13 and wooden floating assemblies 15 are assembled on the vapor barrier 12 in the following manner. Nominal 2"×2" wooden sleepers are placed on the vapor barrier 12 in parallel courses on rows (e.g. 28) running end to end across the short dimension of a room, with the end joints 17 generally abutting one another. The abutting end joints 17 are staggered from row to row, as shown in FIG. 1. A small void is allowed at walls and vertical obstructions. The pads 18 underneath the wooden sleepers are also staggered from row to row.

Figure 2:
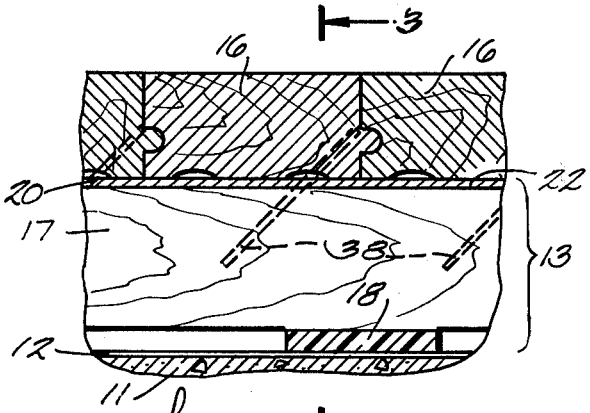
FIG. 2 is a sectional view of the flooring system taken along the line 2—2 in FIG. 1.
Figure 4:
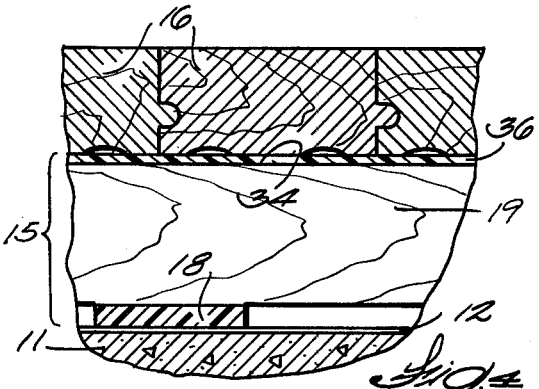
FIG. 4 is a sectional view of the flooring system taken along line 4—4 in FIG. 1.
Figure 3:
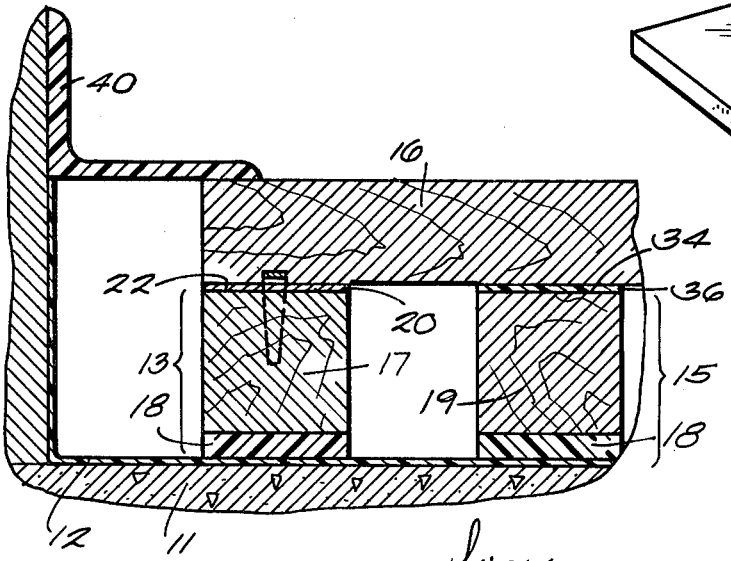
FIG. 3 is a sectional view of the flooring system taken along line 3—3 in FIG. 2.

Restraining strips 20 of 30 gage steel are applied in a continuous ribbon to the top 22 of the wooden sleepers in the beginning row 24, the end row (not shown), and intermittent rows 28 alternating in between the beginning and end rows, as shown in FIGS. 1, 2, and 3. The sleepers to which the restraining strips 20 are applied are the support members 17, and the support members 17, pads 18 and restraining strips 20 comprise the support assemblies 13.

Attached to and extending along tops 34 of the rows 32 of wooden sleepers between the rows of support assemblies 13 are strips of resilient material 36, made preferably of rubber. Each strip 36 is as long as the sleeper to which it is attached, and can be attached to the sleeper either before or after the sleeper is placed on the vapor barrier 12. The uncompressed thickness of the strips of resilient material 36 is greater than the thickness of the steel restraining strips 20. The wooden sleepers to which the strips of resilient material 36 are attached are the floating members 19, and the floating members 19, pads 18 and strips of resilient material 36 together comprise the floating assembly 15.

Superposed at right angles on the support assemblies 13 and floating assemblies 15 are tongue and groove floorboards 16, as shown in FIG. 1. The floorboards 16 are machine nailed 38 or fastened by other means at each intersection with the support assemblies 13, as shown in FIGS. 2 and 3.

Since the pads 18, support members 17, and floating members 19 have uniform dimensions, and since the thickness of the strips of resilient material 36 are thicker than the restraining strips 20, the strips of resilient material 36 are in compression between the floating members 19 and the floorboards 16 in the assembled floor system 10.

To finish the flooring system 10, a rubber base 40 is installed around the perimeter of the floorboards 16 using an adhesive.

Various of the features of the invention are set forth in the following claims.

I claim:

1. A flooring system comprising a foundation, support members on said foundation, floating members on said foundation and located between and generally parallel to said support members, floorboards superposed on said support members and said floating members, strips of resilient material between said floating members and said floorboards, and means for fastening said floorboards to said support members so that said strips of resilient material are in compression between said floorboards and said floating members.

2. A flooring system according to claim 1, wherein said strips of resilient material are attached to and extend generally the length of each of said floating members.

3. A flooring system according to claim 1, wherein rows of said floating members are spaced alternately between rows of said supporting members.

4. A flooring system according to claim 1, wherein said floating members and said support members are made of wood.

5. A flooring system according to claim 1 and further including pads of resilient material attached to and spaced along the underneath of both of said support members and said floating members.

6. A flooring system according to claim 4, and further including restraining strips attached to the top of said wooden support members to resist the upward lifting thrust of said floorboards under conditions of expansion, and said restraining strips being essentially free from dimensional changes in the presence of moisture and restraining said wooden support members against growth parallel to the longitudinal axis of said wooden support members.

7. A flooring system comprising a foundation, rows of wooden support members on said foundation, restraining strips extending along the tops of said wooden support members, said restraining strips being attached to said wooden support members to resist the upward lifting thrust of said floorboards under conditions of expansion, and said restraining strips being essentially free from dimensional changes in the presence of moisture and restraining said wooden support members against growth parallel to the longitudinal axis of said wooden support members, rows of wooden floating members on said foundation and located between and generally parallel to each of said rows of wooden support members, floorboards superposed at right angles on said support members and said floating members, strips of resilient material attached to and extending generally the length of said floating members between said floating members and said floorboards, means for fastening said floorboards to said support members so that said strips of resilient material are in compression between said floorboards and said floating members, and pads of resilient material attached to and spaced along the underneath length of both said support members and said floating members.

8. A flooring system according to claim 7, wherein the combined height of an uncompressed strip of said resilient material and one of said floating members is greater than the combined height of a restraining strip and one of said support members.

9. A flooring system according to claims 1 or 7 wherein said floating members and said support members have uniform dimensions.

10. A flooring system according to claims 1 or 7 wherein said strips of resilient material are made of rubber.

11. A flooring system according to claims 1 or 7 wherein said means for fastening are machine nails.

* * * * *